US005484482A

United States Patent [19]

Rantanen et al.

[11] Patent Number: 5,484,482

[45] Date of Patent: Jan. 16, 1996

[54] METHOD AND APPARATUS FOR LIMITING THE COATING WIDTH AND/OR PREVENTING DAMAGE TO ROLL ENDS WHILE COATING OR SURFACE-SIZING PAPER

[75] Inventors: Rauno Rantanen, Muurame; Markku Lummila; Hannu Korhonen, both of Jyväskylä, all of Finland

[73] Assignee: Valmet Paper Machinery, Inc., Helsinki, Finland

[21] Appl. No.: 217,163

[22] Filed: Mar. 23, 1994

[30] Foreign Application Priority Data

Mar. 25, 1993 [FI] Finland ..... 931341

[51] Int. Cl.[6] ..... B05C 1/08

[52] U.S. Cl. ..... 118/203; 15/256.51; 118/70; 118/244; 118/261; 118/262

[58] Field of Search ..... 118/70, 104, 203, 118/261, 262, 244; 162/199, 265, 272; 15/256.51

[56] References Cited

U.S. PATENT DOCUMENTS

| | | | |
|---|---|---|---|
| 2,155,083 | 4/1939 | Drewsen | 118/70 |
| 3,331,351 | 7/1967 | Werner | 118/70 |
| 4,933,215 | 6/1990 | Naruse et al. | 118/70 |
| 5,328,511 | 7/1994 | Beisswanger | 118/262 |
| 5,383,968 | 1/1995 | Rantanen et al. | 118/262 |

FOREIGN PATENT DOCUMENTS

| | | |
|---|---|---|
| 82107 | 11/1988 | Finland . |
| 920618 | 2/1992 | Finland . |
| 2204255 | 11/1988 | United Kingdom . |

*Primary Examiner*—Peter Chin
*Attorney, Agent, or Firm*—Steinberg, Raskin & Davidson

[57] ABSTRACT

A method and apparatus for limiting the width of a coating and/or preventing damage to roll ends while coating or surface-sizing paper or an equivalent web material in a coating device in which a coating agent, such as size, coating paste or equivalent, is introduced into the coating device to an application zone defined by a coating member, a moving base, lateral seals, and a front wall and spread onto the moving base by the coating member which is loaded against the moving base. Liquid jets are sprayed into the areas outside the coating width, substantially over the width defined by the lateral seals and the roll ends, either onto the moving base before the coating member in the running direction of the moving base or directly into the nip formed by the moving base and the coating member. The liquid jets lubricate the nip and dilute the coating agent that has entered into the areas outside the coating width. The excess amount of the sprayed liquid is collected and removed to prevent entry of the excess amount of the sprayed liquid into a recirculation system the coating agent and prevent the coating agent from being diluted.

20 Claims, 4 Drawing Sheets

METHOD AND APPARATUS FOR LIMITING THE COATING WIDTH AND/OR PREVENTING DAMAGE TO ROLL ENDS WHILE COATING OR SURFACE-SIZING PAPER

BACKGROUND OF THE INVENTION

The present invention relates to a method for limiting the coating width and/or preventing damage to roll ends while coating or surface-sizing paper or an equivalent web material, in a coating device in which method a coating agent, such as size, coating paste or equivalent, is introduced into the coating device to an application zone therein defined by a coating member, a moving base, lateral seals, and a front wall. The coating agent is spread onto the moving base, such as a roll face or a paper or board web that is passed over the roll, by means of the coating member which is loaded against the moving base.

The present invention also relates to an apparatus for limiting the coating width and/or preventing damage to the roll ends while coating or surface-sizing paper or an equivalent web material in a coating device which comprises an application zone defined by a coating member, a moving base, such as a roll face or a paper or board web that is passed over the roll, lateral seals, and a front wall. A coating agent, such as size, coating paste or equivalent, is introduced into the application zone. The coating member is loaded against the moving base and is arranged to spread and smooth the coating agent onto the moving base.

While coating and surface-sizing paper or an equivalent web material, two alternative methods and devices are commonly used, i.e., a blade coater or a bar coater. In particular in the surface-sizing technique, bar coaters have been used increasingly in recent years, because their usability has proved very advantageous. In coating and surface-sizing, a bar coater is used for spreading and smoothing the coating agent onto the face of the paper or of an equivalent web material, the coating agent being usually applied to the web face by means of an applicator roll. In film size presses, the coating agent may also be applied directly onto the faces of the size-press rolls, from which rolls it adheres in the roll nip to the web running through the nip. As stated above, either a revolving coating bar or a coating blade can be used as the coating member.

When the coating agent is applied, e.g., by means of a grooved coating bar onto the rolls in a size press, the end areas of the roll (also referred to as roll end areas) placed outside the web must be doctored clean by means of lateral doctors. Otherwise, any coating agent remaining in the end areas of the rolls would cause considerable splashing in the roll nip. The doctoring of the lateral areas has proved very difficult, and it also abrades the roll face to a considerable extent. With the introduction of pigmenting techniques with a pigment having a high dry solids content, multiple problems have been encountered in the lateral areas on the rolls. The conventional lateral jets intended for surface sizing have usually been placed in a location in which they have been blocked readily, because the coating paste flows and splashes onto them. If the lateral jets are blocked, lubrication of the lateral areas is prevented, as a result of which, the end areas of the rolls are easily damaged.

It is a further, highly significant drawback of the conventional constructions that the lubrication water coming from the lateral jets passes directly into the recirculation system and conduits of the coating agent, where it dilutes the coating paste. In pigmenting with coating pastes of a high dry solids content, the diluting waters must be minimized. Since the quantity of lubrication water must be minimized, the coating width cannot be effectively controlled and limited sufficiently well. As a result, it has been necessary to employ lateral doctors which abrade the roll ends to a considerable extent, as was stated above. Another disadvantage is that the lateral doctors do not operate reliably with coating pastes or agents having high dry solids contents. Also, small quantities of water produce drying of the paste on the roll face, which causes heating of the coating bar in bar coaters and heating of the coating blade in blade coaters. The heating of the coating member, e.g., coating bar or coating blade, may result in damage to the bar cradle and/or to the roll coating in the lateral areas.

OBJECTS AND SUMMARY OF THE INVENTION

Accordingly, it is an object of the present invention to provide a new and improved method and device by whose means the above problems and drawbacks related to the prior art are substantially avoided and solved.

It is another object of the present invention to provide and new and improved method and device for use while coating or surface-sizing paper in which the width of the coating applied by the device to the moving base can be efficiently regulated.

It is another object of the present invention to provide and new and improved method and device for use while coating or surface-sizing paper in which damage to the coating member is substantially avoided.

In view of achieving these objects, and others, in the method in accordance with the invention, liquid is sprayed into the areas outside the coating width, substantially over the width of the roll defined by the lateral seals of the application zone and the ends of the roll. The liquid is sprayed either onto the moving base in the running direction of the moving base immediately before the coating member or directly into the nip between the moving base and the coating member, to lubricate the nip and dilute the coating agent that has entered into the areas outside the coating width. The excess amount of the sprayed liquid is collected and removed to prevent its entering into the recirculation system and conduits of the coating agent, so as to prevent the coating agent from being diluted. Especially in the case of a grooved bar, it is also possible to employ water jets exclusively for lubrication and cooling of the end areas of the roll, in which case, before the bar, the lubrication water can be doctored, e.g., by means of a blade into a recirculation trough of its own.

In a preferred embodiment, jet pipes are arranged in a direction transverse to a machine direction of the coating device to spray the liquid. Preferably, there are two jet pipes, one each arranged at least in the area outside the coating width between the ends of the roll and a respective one of the lateral seals. The liquid to be sprayed onto the moving base or into the nip is passed through holes or nozzles in the jet pipes. Collecting troughs are arranged underneath the jet pipes to collect and remove the excess amounts of the sprayed liquid. The coating device may also include a feed pipe and a feed chamber through which the coating agent is passed from the feed pipe to the application zone. The feed chamber may be partitioned to define lateral compartments outside the coating width through which the excess amount of sprayed liquid is removed. The jet pipes and collecting troughs can be shifted either separately from or together with the respective lateral seals to thereby regulate, i.e., limit the size of, the coating width which may be defined as the width of the face of the roll or paper or board web material being coated in the coating device.

In the device in accordance with the invention, spray means such as jet pipes are installed to spray liquid in the areas outside the coating width, substantially over the width defined by the lateral seals and the roll ends, either onto the moving base in the running direction of the moving base immediately before the coating member, or directly into the nip between the moving base and the coating member to lubricate the nip and dilute the coating agent that has entered into the areas outside the coating width. The device has additionally been provided with means for collecting and removing the sprayed excess quantity of liquid so that access of the excess quantity of liquid into the recirculation system of the coating agent is prevented.

By means of the method and apparatus in accordance with the present invention, compared with the prior art constructions, a considerable advantage is obtained in particular in the respect that, in the invention, the lubrication water cannot be carried into the recirculation of the paste or coating agent to dilute the paste. Rather, the lubrication water is collected off separately. Especially when coating with coating pastes having a high dry solids content, such prevention of dilution of the paste is a considerable improvement over the prior art. Since the lubrication water is collected and drained off separately, larger quantities of water can be used than in connection with the prior art lateral jets spray devices, in which case the paste cannot be dried on the roll face even with high dry solids contents, so that any disturbance arising from such drying can also be avoided by means of the present invention.

Further advantages and characteristic features of the present invention come out from the following detailed description of the invention.

BRIEF DESCRIPTION OF THE DRAWINGS

In the following, the invention and its theoretical background will be described in detail with reference to the figures in the accompanying drawings and to preferred exemplifying embodiments of the invention illustrated therein.

DETAILED DESCRIPTION OF THE INVENTION

Figure 1:
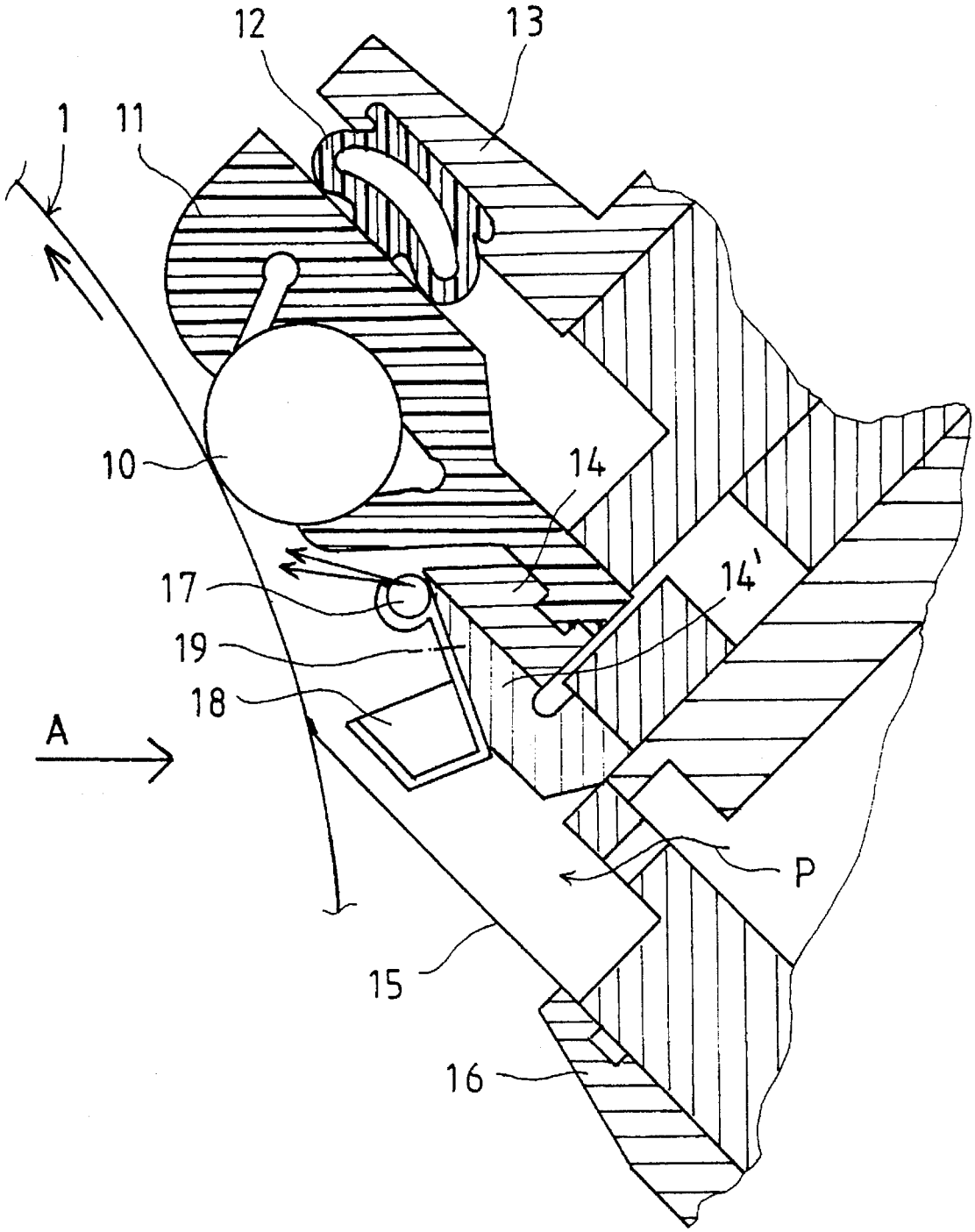
FIG. 1 is a fully schematic sectional view which illustrates a first embodiment of a coating device provided with the device in accordance with the present invention and used in a method in accordance with the invention.

Referring to the accompanying drawings wherein like reference numerals refer to the same elements, FIG. 1 shows a device for coating or surface-sizing of a web material, by means of which device a pigment paste is applied to a face 1 of a roll by means of the "short-dwell technique" so that the size or pigment paste P is fed to an application zone and then onto the roll face 1. The application zone is defined by a revolving bar 10 which operates as the coating member, a dam blade 15 or an equivalent front wall of the application zone, the roll face 1, and lateral seals (not shown in FIG. 1). By means of the dam blade or front wall 15, the overflow of the size or coating paste from the application zone into the collecting trough (not shown) is regulated as known in prior art. The bar 10 that operates as the coating member is mounted revolvingly in the bar cradle 11, which is mounted conventionally in the bar-cradle holder 14. The holder 14, and thus the cradle 11, is secured in its position by means of fastening or tightening means 14'. Behind the bar cradle 11, a loading hose 12 is provided and acts upon the rear face of the bar cradle. The loading hose 12 is mounted in a hose holder 13 which may also operate as a profile bar. By means of the loading hose 12, the coating member 10 is loaded with the desired force and pressure against the roll face 1. The dam blade 15 or the front wall is attached conventionally to a holder 16 of its own.

Figure 2A:
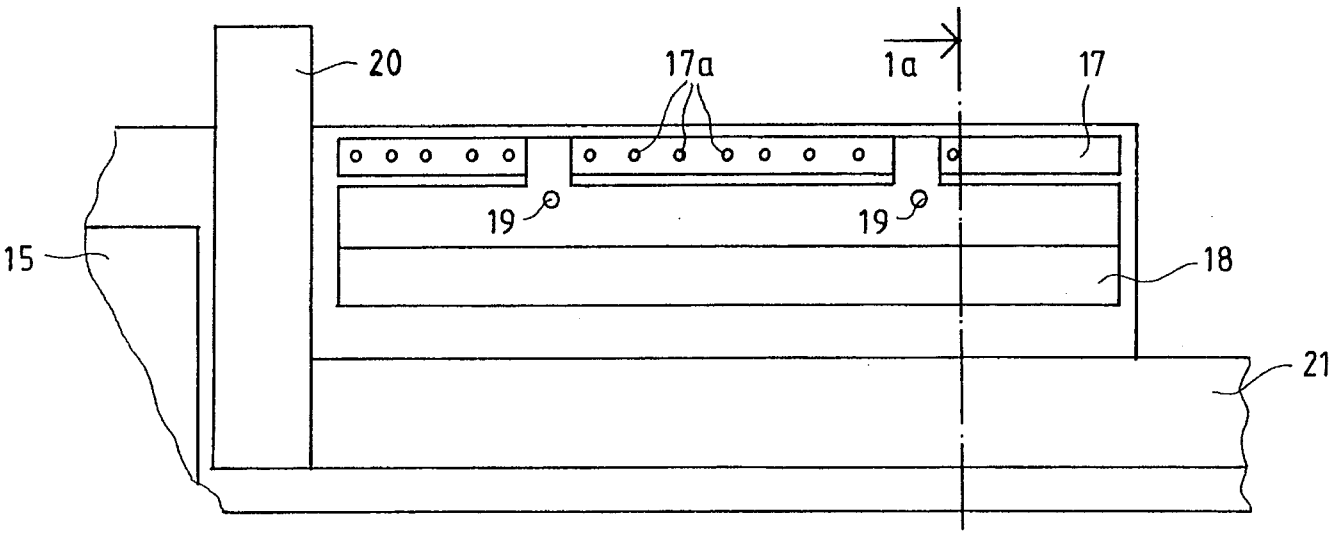
FIG. 2A is an illustration taken in the direction of the arrow A in FIG. 1 of the device in accordance with the present invention arranged in a coating device.
Figure 2B:
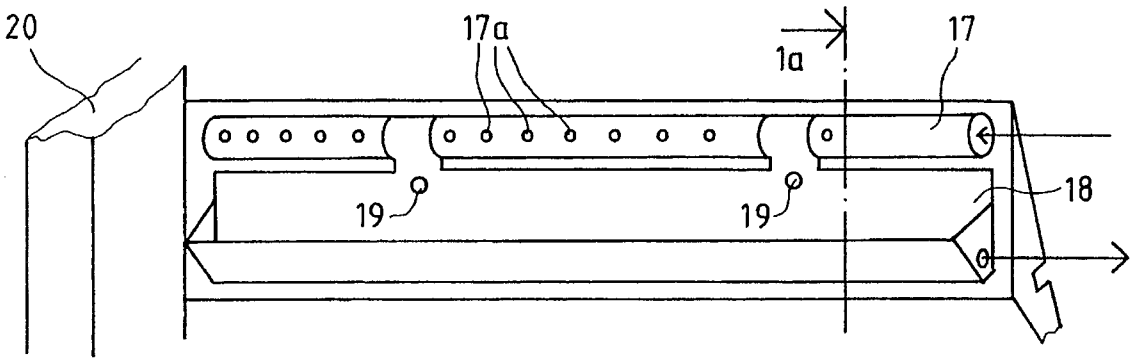
FIG. 2B is an axonometric view of the device in accordance with the present invention as shown in FIG. 2A.

In a coating device of the type described above, the device in accordance with the present invention is installed and comprises spray means such as a jet pipe 17 placed in the transverse direction of the machine and a collecting trough 18 or other collecting and removing means. The jet pipes 17 and collecting troughs 18 may be attached to the holder 14 of the bar cradle or to the fastening and tightening means 14' of the holder by means of fastening members 19, in the direction of rotation of the roll, as close to the coating bar 10 as possible before the nip between the coating bar 10 and the roll. The construction of the device of the present invention is illustrated in more detail in FIGS. 2A and 2B. As comes out in particular from FIGS. 2A and 2B, the construction that consists of the jet pipe 17 and the collecting trough 18 is arranged in the area between the lateral seal 20 of the application zone and the roll end, which is denoted by a dashed-dotted line and with reference la in FIGS. 2A and 2B. The jet pipe 17 is provided with a number of holes **17*a* that have been formed into the wall of the pipe and liquid jets are applied through the holes towards the nip between the coating bar 10** and the roll.

In a preferred embodiment, the collecting trough 18 is arranged underneath, e.g, below, the jet pipes 17 so that the excess liquid may flow due to gravity into the collecting troughs.

The equipment that comprises the jet pipe 17 and the collecting trough 18 may be arranged to be displaceable in the transverse direction of the machine in view of permitting a ready adjustability of the coating width. In its simplest form, this adjustability is accomplished so that the fastening holes in the equipment 17,18, through which holes the equipment is attached to the bar-cradle holder 14 or to the fastening and tightening means of the holder by means of fastening members 19, such as screws, are formed oblong in the transverse direction of the machine. The spray equipment 17,18 may also be provided with transfer means or shifting means (not shown), by whose means its location can adjusted even during operation of the machine. Further, it is possible that the spray equipment 17,18 is connected together with the lateral seals 20, in which case they are transferred together. In such a case, regulation of the coating width is even more efficient. The spray equipment 17,18 may also be arranged to be separate from the lateral seals 20 by the movement of the spray equipment 17,18 and laterals seals 20 can be coordinated to provide the desired regulation of the coating width.

The liquid to be sprayed is preferably water, into which air may be fed and mixed therewith so as to disintegrate the water into very small drops. By means of the liquid jets, the paste is diluted in the lateral areas of the roll, in which case the paste quantity in the lateral areas of the roll remains substantially lower, because the paste that flows into the end areas beyond the lateral seals has been diluted extensively by means of the abundant water. In this case, owing to the low hydrodynamic forces, the smooth bar, the smooth end area of a grooved bar, or the coating blade, which is used as the doctoring member, permits just a thin film to pass through the doctor. In some cases, it is possible that the lateral doctors can be omitted completely. Thus, a little proportion of the liquid jets lubricates the nip between the bar 10 and the roll, whereas the rest of the sprayed liquid flows away, and this excess liquid is collected and recovered in the collecting trough 18, from which it is drained off and removed so that the liquid does not enter into the coating-agent collecting trough to dilute the coating agent.

As stated above, the excess liquid is collected off, so that detrimental dilution of the coating agent cannot occur. In some cases, lateral doctors need not be used at all, because, owing to the liquid fed into the lateral areas, the liquid quantity coming through the nip between the coating bar 10 and the roll is so little that it does not splash at all in the nip in the size press. For example, if the lateral seals 20 are worn and coating agent, such as paste or equivalent, can flow into the lateral areas, the liquid quantity to be sprayed can be increased to such a high level that the dry solids content of the coating paste in the areas of the roll ends is lowered and the film layer between the coating bar 10 and the roll is sufficiently thin, so that lateral doctors are not needed. In such a case, the liquid quantity to be sprayed can be even several liters per minute for each end of the roll. Since the liquid quantities to be used are allowed to be large, the holes 17*a* in the jet pipe 17 may also be formed sufficiently large, in which case they cannot be blocked. Since the jet pipe 17 is placed immediately before the coating bar 10, in the direction of rotation of the roll, detrimental splashing of the coating agent, such as paste, cannot occur either, and in such a case the holes 17*a* in the jet pipe 17 remain open. Owing to the efficient lubrication and cooling, the coating bar 10 cannot be heated, in which case damage to the bar cradle and/or to the roll cannot occur either.

In view of a further improvement of the lubrication of the nip and reduction in the friction between the coating bar 10 and the end area of the roll, it is advisable to add a lubricating agent suitable for this purpose to the liquid to be sprayed.

Figure 3:
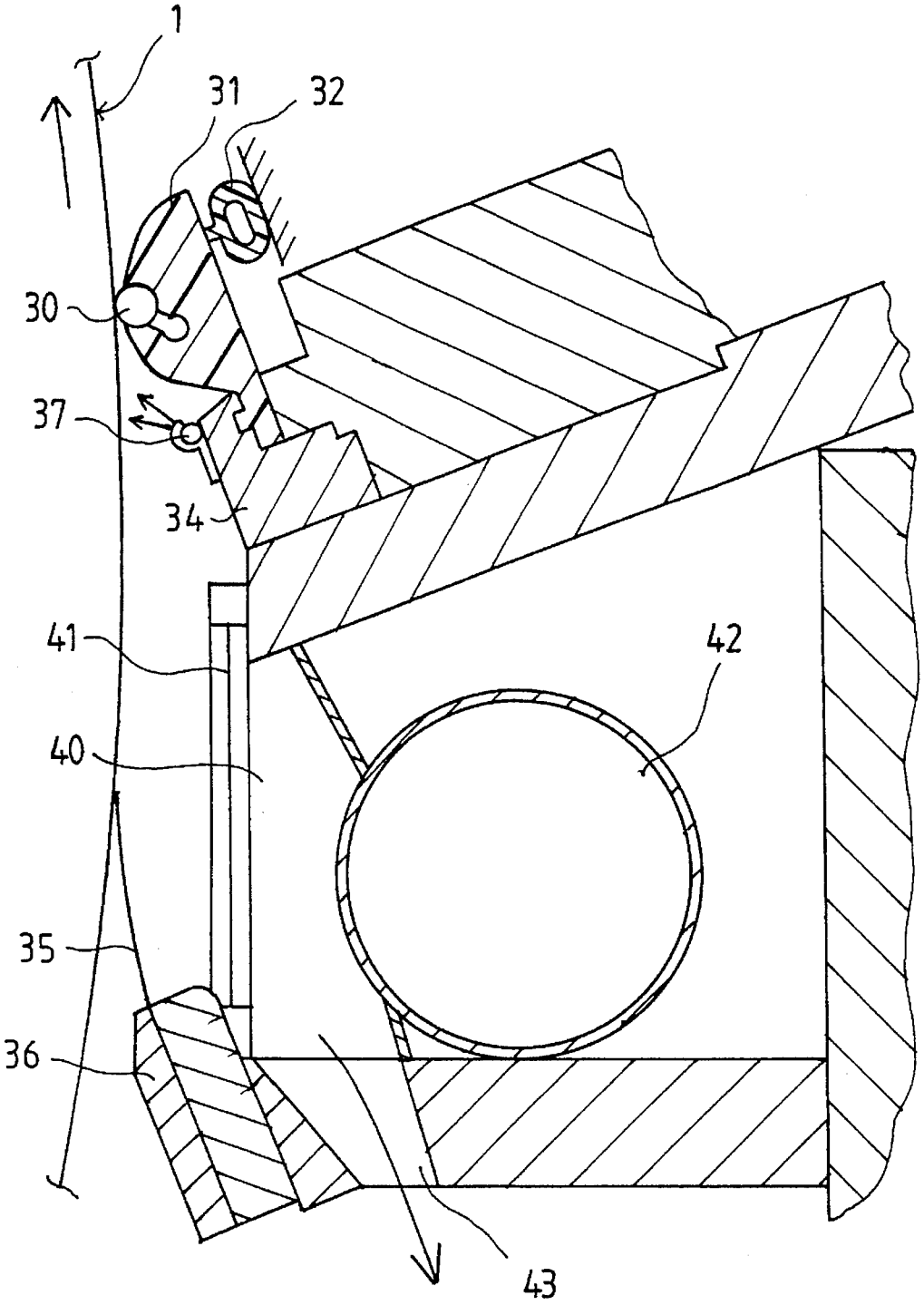
FIG. 3 is an illustration corresponding to FIG. 1 of a second embodiment of a coating device provided with the device in accordance with the invention and used in a method in accordance with the invention.

FIG. 3 shows an alternative embodiment of the method and the equipment in accordance with the invention as used in a typical coating device. Also in the embodiment of FIG. 3, the application of the size or coating-agent film onto the roll face 1 is carried out by means of the "short-dwell technique" so that, in the coating device, the size or an equivalent coating agent is fed to the application zone, which is defined by a revolving coating bar 30, which operates as the coating member, a dam blade 35 or a front wall of the application zone, respectively, the roll face 1, and lateral seals (not shown). By means of the dam blade 35 or the corresponding front wall, which is installed in a holder 36 of its own in the conventional way, the overflow of the size or coating agent from the application zone into the collecting trough (not shown) is regulated in a way known from prior art. The coating bar 30 is installed so that it can revolve in the coating-bar cradle 31, which is attached to the cradle holder 34 in a known way. Behind the cradle 31 of the coating bar, a loading hose 32 is arranged and acts upon the rear face of the cradle. By means of the loading hose, the loading pressure of the coating bar 30 against the roll face 1 is regulated.

In the coating device as shown in FIG. 3, in the coating-agent feed chamber 40, a feed pipe 42 for the coating agent, such as size or equivalent, is installed. The feed pipe is placed in the transverse direction of the machine and feeds coating agent to the application zone. The construction of the coating-agent feed chamber 40 and of the feed pipe 42 may be similar to that described, e.g., in the assignee' s Finnish Patent Application No. 920618 of earlier date.

Figure 3A:
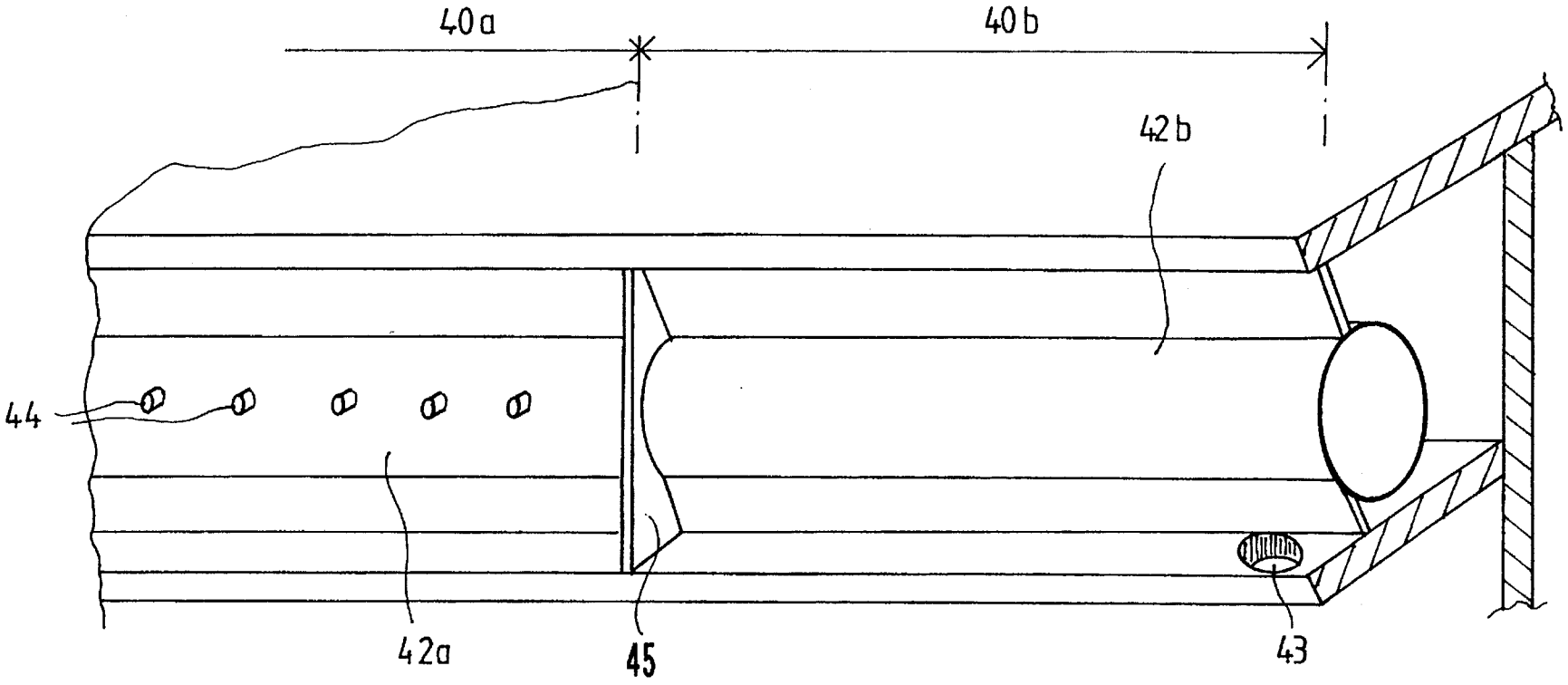
FIG. 3A is an axonometric view of a detail of FIG. 3.

In the device in accordance with the invention, the construction and operation of the feed chamber and the feed pipe 42 are illustrated in more detail in FIG. 3A. Between the feed chamber 40 and the application zone, across the coating width, a plate 41 or equivalent is installed, into which a necessary number of through holes (not shown) have been formed. The holes are placed at a suitable invariable distance from one another in the transverse direction of the machine. From the feed pipe 42, the coating agent is fed through nozzles 44 that have been formed in the pipe. A large number of such nozzles are provided in the transverse direction of the machine at an invariable distance from one another across the coating width. Nozzles 44 form a first throttle for the coating-agent flow. Also, a second throttle is provided for the coating-agent flow, which second throttle comprises the through holes (not shown) that have been formed into the plate 41. By means of these throttles, the coating-agent flow can be passed as uniformly as possible to the application zone. As is the case in the embodiment of FIG. 1, so also in the embodiment shown in FIG. 3, a jet pipe 37 is fitted in the coating device, and the construction and operation of the jet pipe 37 may be similar to the construction illustrated in FIGS. 1, 2A and 2B. Thus, through the jet pipe 37, liquid jets are fed in the direction of rotation of the roll, as close as possible to the nip formed by the coating bar 30 and the roll face 1 before the nip.

In the embodiment of FIGS. 3 and 3A, the coating-agent feed chamber 40 has been divided by means of partition walls 45 into three separate compartments so that a middle compartment 40*a* covers the coating width of the web. The partition walls 45 in the feed chamber 40 are placed substantially at the lateral seals (not shown). Thus, the nozzles 44 are also formed in the feed pipe 42*a* substantially exclusively in the area of the coating width, i.e., at the middle compartment 40*a* of the feed chamber. In the area of the middle compartment 40*a*, the coating agent is applied to the roll face 1 and the excess coating agent is made to flow to the recirculation system for the coating agent (not shown).

In the lateral compartments 40*b* of the coating-agent chamber, i.e., between the partition walls 45 and the roll ends, the feed pipe 42*b* is closed, so that in this area no nozzles have been arranged into the pipe. Thus, in the lateral compartments 40*b*, no feed of coating agent to the application zone takes place. Instead, in the areas of the lateral compartments 40*b*, spraying of liquid is carried out through the jet pipes 37 to the end areas of the roll so as to lubricate the roll ends. Likewise, in the areas of the lateral compartments 40*b*, the excess quantity of the sprayed liquid is collected and drained off so that the excess sprayed liquid flows into the lateral compartments 40*b* in the feed chamber. From the lateral compartments, the excess sprayed liquid is drained off, e.g., through one or several openings 43 formed in the bottom of the feed chamber, so that the liquid does not enter into the recirculation system and conduits of the coating agent and dilution of the coating agent is substantially prevented. Thus, the embodiment of FIGS. 3 and 3A does not include the collecting trough shown in FIGS. 1, 2A and 2B.

Above, with reference to the figures in the drawing, the invention has been described in connection with a coating device in which the coating member is a revolving bar 10,30 resting against the roll face 1. Coating bar 10,30 is preferably a smooth-faced bar, but the invention is also suitable for use in connection with a grooved bar, because, also in such a case, the same advantage is obtained with respect to the prevention of the dilution of the coating agent. Further, it is possible to employ the device in accordance with the invention in connection with a blade coater, i.e., in a coating device in which, instead of the coating bars 10,30 shown in the accompanying drawing,s a coating blade is used as the coating member. When coating is carried out by means of a coating blade, the problem of spreading of the coating paste is experienced even more clearly than when a coating bar is used, so that, by means of the present invention, the problem of spreading can also be brought under control in blade coaters.

Further, the present invention can also be applied to coating taking place directly onto the web. In this case, in the embodiments shown in FIGS. 1 and 3, the web would be passed along the roll face 1, and the coating agent would be applied by means of the coating members 10,30 directly onto the face of the web.

Further, instead of limiting the coating width, the invention can also be used exclusively in order to cool the coating member, to lubricate the nip between the coating member and the roll end area, and to keep the roll end areas clean.

The examples provided above are not meant to be exclusive. Many other variations of the present invention would be obvious to those skilled in the art, and are contemplated to be within the scope of the appended claims.

We claim:

1. Method for limiting the width of a coating and/or preventing damage to end areas of a roll while coating or surface-sizing paper or other web material in a coating device in which a coating agent is introduced into an application zone defined by lateral seals, a moving base selected from the group consisting of a face of a roll, a paper web passed over a roll and a board web passed over a roll, a front wall contiguous with said moving base, and a coating member in a nip-forming relationship with said moving base, said coating member comprising either a rotating bar or a blade extending along a length of said moving base upstream from said front wall, and wherein said coating member is loaded against said moving base and spreads a coating agent onto said moving base in said nip, and in which device excess coating agent is removed by a recirculation system, the method comprising the steps of:

spraying a liquid in an area outside of said coating width between ends of the roll and said lateral seals in a running direction of said moving base either onto the roll before said coating member or directly into said nip, to lubricate said nip and dilute said coating agent in the area between the ends of the roll and said lateral seals, the liquid being sprayed from a location between said front wall and said nip, and removing excess amounts of the sprayed liquid via a collection system separate from said recirculation system for said coating agent to prevent entry of the excess liquid into said recirculation system for said coating agent and said coating agent from being diluted by the sprayed liquid.

2. The method of claim 1, further comprising the steps of arranging jet pipes in a direction transverse to a machine direction of said coating device, each of said jet pipes being arranged at least between the ends of the roll and a respective one of said lateral seals, providing holes in walls of said jet pipes, and introducing the liquid to be sprayed onto the roll or into said nip through the holes in said jet pipes.

3. The method of claim 2, further comprising the step of arranging collecting troughs which constitute said collection system underneath said jet pipes to collect and remove the excess amounts of the sprayed liquid.

4. The method of claim 2, wherein said coating device includes a feed pipe and a feed chamber through which said coating agent is passed from said feed pipe to said application zone, the method further comprising the step of partitioning said feed chamber to define lateral compartments situated opposite areas between the ends of the roll and said lateral seals, the excess amount of sprayed liquid being removed through said lateral compartments.

5. The method of claim 1, wherein the liquid being sprayed is water.

6. The method of claim 1, further comprising the step of mixing air with the sprayed liquid to disintegrate the liquid into small drops.

7. The method of claim 1, further comprising the step of adding a lubricating agent to the sprayed liquid to lower friction between said coating member and areas of the roll between the ends of the roll and said lateral seals.

8. The method of claim 3, further comprising the step of regulating the coating width by shifting said jet pipes and collecting troughs in the transverse direction either separately from or together with said lateral seals.

9. Method for cooling a coating member in a coating device for coating or surface-sizing paper or other web material and keeping end areas of a roll in said coating device clean, in which coating device a coating agent is introduced into an application zone defined by lateral seals, a moving base selected from the group consisting of a roll face, a paper web passed over a roll and a board web passed over a roll, a front wall contiguous with said moving base, and a coating member in a nip-forming relationship with said moving base, said coating member comprising either a rotating bar or a blade extending along a length of said moving base upstream from said front wall, and wherein said coating member is loaded against said moving base and spreads a coating agent onto said moving base in said nip, and in which device excess coating agent is removed by a recirculation system, the method comprising the steps of:

lubricating portions of said nip between ends of the roll and said lateral seals by spraying a liquid between the ends of the roll and said lateral seals in a running direction of said moving base either onto the roll before said coating member or directly into said nip, the liquid being sprayed from a location between said front wall and said nip, and removing excess amounts of the sprayed liquid via a collection system separate from said recirculation system for said coating agent.

10. Apparatus for limiting the width of a coating and/or preventing damage to ends of a roll while coating or surface-sizing paper or other web material in a coating device in which a coating agent is introduced into an application zone defined by lateral seals, a moving base selected from the group consisting of a roll face, a paper web passed over a roll and a board web passed over a roll, a front wall contiguous with said moving base, and a coating member in a nip-forming relationship with said moving base, said coating member comprising either a rotating bar or a blade extending along a length of said moving base upstream from said front wall, and wherein said coating member is loaded against said moving base and spreads and smoothes a coating agent onto said moving base in said nip, and in which device excess coating agent is removed by a recirculation system, the apparatus comprising means for spraying a liquid in areas outside of the coating width between ends of the roll and said lateral seals in a running direction of said moving base either onto the roll before said coating member or directly into said nip, the sprayed liquid lubricating said nip and diluting said coating agent in the areas outside the coating width, said spray means being arranged between said front wall and said nip, and means for collecting and removing excess amounts of the sprayed liquid to prevent entry of the excess liquid into said recirculation system for said coating agent and said coating agent from being diluted by the sprayed liquid, said collecting and removing means being separate from said recirculation system for said coating agent.

11. The apparatus of claim 10, wherein said spray means comprise jet pipes having apertures therein through which the liquid is sprayed, said jet pipes being arranged at least in the area outside the coating width between the ends of the roll and a respective one of said lateral seals.

12. The apparatus of claim 11, wherein said coating member is a coating bar, further comprising a bar cradle in which said coating bar is mounted, a holder for retaining said cradle and fastening and tightening means for securing said holder in contact with said cradle, said jet pipes being attached to said holder or to said fastening and tightening means, said jet pipes being arranged in a direction transverse to a machine direction of said coating device and comprising through holes through which liquid jet are direct to impact said nip or impact against the roll.

13. The apparatus of claim 11, wherein said collecting and removing means comprise collecting troughs arranged below said jet pipes to recover and drain off the excess amount of the sprayed liquid.

14. The apparatus of claim 12, wherein said collecting and removing means comprise collecting troughs arranged below said jet pipes to recover and drain off the excess amount of the sprayed liquid, said collecting troughs being attached to said holder or to said fastening and tightening means.

15. The apparatus of claim 14, wherein said jet pipes and said collecting troughs are fixed by means of common fastening members to said holder or said fastening and tightening means.

16. The apparatus of claim 10, further comprising a feed pipe for feeding said coating agent into said device, a coating-agent feed chamber being defined between said feed pipe and said application zone in a direction transverse to a machine direction of said device such that said coating agent is passed from said feed pipe through said feed chamber and into said application zone, and partition walls for partitioning said feed chamber into a middle compartment and a lateral compartment on each side of said middle compartment, said coating agent being fed into said application zone through said middle compartment of said feed chamber, and the excess amounts of sprayed liquid being collected and removed through said lateral compartments.

17. The apparatus of claim 10, wherein said spray means and said collecting and removing means are displaceable in a direction transverse to the machine direction of said device.

18. The apparatus of claim 10, wherein said spray means and said collecting and removing means are connected to said lateral seals such that said spray means and said collecting and removing means are jointly movable.

19. The apparatus of claim 10, wherein said coating agent is size or coating paste.

20. Device for coating a moving base selected from the group consisting of a face of a roll, a paper web passed over a roll and a board web passed over a roll, the device including a front wall defining an application zone, comprising lateral seals defining a coating width of said moving base therebetween, a coating member arranged in a nip-forming relationship with the moving base, said coating member comprising either a rotating bar or a blade extending along a length of the moving base upstream from the front wall and being loaded against the moving base to spread and smooth the coating agent onto the moving base in said nip, a recirculation system for removing excess coating agent, means for spraying a liquid in areas outside of the coating width between ends of the roll and said lateral seals in a running direction of the moving base either onto the roll before said coating member or directly into said nip, the sprayed liquid lubricating said nip and diluting the coating agent in the areas outside the coating width, said spray means being arranged between said front wall and said nip, and means for collecting and removing excess amounts of the sprayed liquid to prevent entry of the excess liquid into said recirculation system for the coating agent and the coating agent from being diluted by the sprayed liquid, said collecting and removing means being separate from said recirculation system for the coating agent.

* * * * *